US010511114B2

(12) United States Patent
Nakamura et al.

(10) Patent No.: US 10,511,114 B2
(45) Date of Patent: Dec. 17, 2019

(54) CONTACT

(71) Applicant: KITAGAWA INDUSTRIES CO., LTD., Aichi (JP)

(72) Inventors: Tatsuya Nakamura, Aichi (JP); Ichiro Nakagawa, Aichi (JP); Kazushige Ueno, Aichi (JP)

(73) Assignee: KITAGAWA INDUSTRIES CO., LTD., Aichi (JP)

( * ) Notice: Subject to any disclaimer, the term of this patent is extended or adjusted under 35 U.S.C. 154(b) by 0 days.

(21) Appl. No.: 16/306,351

(22) PCT Filed: Jun. 2, 2017

(86) PCT No.: PCT/JP2017/020682
§ 371 (c)(1),
(2) Date: Nov. 30, 2018

(87) PCT Pub. No.: WO2017/209291
PCT Pub. Date: Dec. 7, 2017

(65) Prior Publication Data

US 2019/0190184 A1 Jun. 20, 2019

(30) Foreign Application Priority Data

Jun. 2, 2016 (JP) ..... 2016-110847
Jun. 10, 2016 (JP) ..... 2016-116427

(51) Int. Cl.
*H01R 13/24* (2006.01)
*H01R 12/71* (2011.01)

(52) U.S. Cl.
CPC ..... *H01R 13/24* (2013.01); *H01R 12/71* (2013.01)

(58) Field of Classification Search
CPC ..... H01R 12/57; H01R 12/71; H01R 13/24
(Continued)

(56) References Cited

U.S. PATENT DOCUMENTS 5,600,092 A * 2/1997 Patscheck ..... H01R 4/64 174/351
5,655,913 A 8/1997 Castaneda et al.
(Continued)

FOREIGN PATENT DOCUMENTS

JP 2001-053457 A 2/2001
JP 2002-184503 A 6/2002
(Continued)

OTHER PUBLICATIONS

International Search Report (with English Translation) and Written Opinion of the Japanese International Searching Authority. Application No. PCT/JP2017/020682. dated Aug. 22, 2017. 11 pages.
(Continued)

*Primary Examiner* — Briggitte R. Hammond
(74) *Attorney, Agent, or Firm* — Meunier Carlin & Curfman LLC

(57) ABSTRACT

A contact includes a base portion fixable to a first member, a contact portion configured to make contact with a second member, and a spring portion configured to displaceably support the contact portion. The base portion, the contact portion, and the spring portion are integrally formed with a thin plate made of metal. The contact portion includes a flat plate portion extending in a flat plate shape from one end of a bent portion, and a protrusion protruding toward the second member is provided on the flat plate portion. The protrusion is provided at a location separated from a boundary between the contact portion and the spring portion by greater than or equal to 0.9 mm toward the contact portion.

6 Claims, 4 Drawing Sheets

(58) Field of Classification Search
USPC ..... 439/66, 862
See application file for complete search history.

(56) References Cited

U.S. PATENT DOCUMENTS

| | | | | |
|---|---|---|---|---|
| 6,051,781 | A * | 4/2000 | Bianca | H05K 9/0016 174/250 |
| 6,149,443 | A * | 11/2000 | Moran | H01R 13/2435 439/66 |
| 6,305,067 | B1 * | 10/2001 | Horng | C22F 1/08 29/458 |
| 6,493,241 | B1 * | 12/2002 | Horng | H05K 9/0064 206/719 |
| 6,872,881 | B2 * | 3/2005 | Horng | H05K 9/0035 174/384 |
| 7,938,647 | B2 * | 5/2011 | Zheng | H01R 12/714 439/66 |
| 7,972,186 | B2 * | 7/2011 | Tsao | H01R 12/585 439/876 |
| 7,989,045 | B2 * | 8/2011 | Chang | H01R 12/57 174/366 |
| 8,052,428 | B2 * | 11/2011 | Tsao | H01R 13/24 439/66 |
| 9,281,591 | B2 * | 3/2016 | Kurita | H05K 9/0016 |
| 10,348,008 | B2 * | 7/2019 | Nakamura | H01R 4/02 |
| 2011/0189902 | A1 | 8/2011 | Haans et al. | |
| 2014/0087605 | A1 * | 3/2014 | Kiryu | H01R 13/2442 439/884 |
| 2015/0038001 | A1 * | 2/2015 | Kiryu | H01R 12/714 439/370 |

FOREIGN PATENT DOCUMENTS

| | | | |
|---|---|---|---|
| JP | 2007-250320 | A | 9/2007 |
| JP | 4482533 | A | 6/2010 |
| JP | 2010-161010 | A | 7/2010 |
| JP | 2011-171298 | A1 | 9/2011 |
| JP | 2015-079599 | A | 4/2015 |
| JP | 2016-212850 | A | 12/2016 |
| JP | 2016-212950 | A | 12/2016 |

OTHER PUBLICATIONS

International Preliminary Report on Patentability (English Translation). International Application No. PCT/JP2017/020682. dated Dec. 2018. 9 pages.

* cited by examiner

CONTACT

CROSS-REFERENCE TO RELATED APPLICATIONS

This international application claims priority to Japanese Patent Application No. 2016-110847, filed to the Japanese Patent Office on Jun. 2, 2016, and Japanese Patent Application No. 2016-116427, filed to the Japanese Patent Office on Jun. 10, 2016, and the entire content of Japanese Patent Application No. 2016-110847 and Japanese Patent Application No. 2016-116427 are hereby incorporated by reference.

TECHNICAL FIELD

The present disclosure relates to a contact.

BACKGROUND ART

A contact configured to be capable of electrically connecting a first member and a second member by being attached to the first member and sandwiched between the first member and the second member is known as a component used for grounding (for example, see Patent Document 1). This type of contact is, for example, soldered to a conductor pattern of an electric circuit board (corresponding to an example of the first member), and comes into contact with a conductive member (corresponding to an example of the second member) separate from the electronic circuit board. This allows the conductor pattern and the conductive member to be electrically connected.

CITATION LIST

Patent Literature

Patent Document 1: JP 4482533 B

SUMMARY OF INVENTION

Technical Problem

When the contact described above is brought into contact with the second member, and the contact is brought into contact with a counterpart metal having a large potential difference, corrosion (for example, galvanic corrosion or the like) arising from the contact of dissimilar metals may occur. When such corrosion occurs, there is a problem that the resistance value greatly increases between the contact and the second member. In particular, the above phenomenon is likely to occur in environments where temperature rapidly varies between high and low temperatures, as in the engine compartment of automobiles.

In view of the circumstances described above, it is desirable to provide a contact that can suppress an increase in resistance values due to the corrosion as described above.

Solution to Problem

The contact described below is a contact configured to be capable of electrically connecting a first member and a second member by being attached to the first member and sandwiched between the first member and the second member, the contact including: a base portion fixable to the first member; a contact portion configured to make contact with the second member at at least one contact point; and a spring portion configured to be elastically deformable between both ends, where one end is a fixed end connected to the base portion and another end is a free end connected to the contact portion, and to displaceably support the contact portion. The base portion, the contact portion, and the spring portion are integrally formed with a thin plate made of metal, the spring portion includes a bent portion curved in a direction in which a thickness direction of the thin plate is a radial direction, the contact portion includes a flat plate portion extending in a flat plate shape from one end of the bent portion, a protrusion protruding toward the second member is provided on the flat plate portion as one of the at least one contact point, and the protrusion is provided at a location separated from a boundary between the contact portion and the spring portion by greater than or equal to 0.9 mm toward the contact portion.

According to the contact configured this way, when the base portion is fixed relative to the first member and the contact is sandwiched between the first member and the second member, the contact portion comes into contact with the second member at at least one contact point. This allows the first member and the second member to be electrically connected.

In addition, the contact portion comes into contact with the second member at the tip of the protrusion, as described above. For this reason, as compared with cases in which such a protrusion is not provided, the contact can be brought into contact with the second member at a small contact point. Accordingly, the contact pressure can be increased in comparison to contacts without protrusions that come into contact with the second member with a large contact surface. This can prevent oxygen, water, or the like from entering the contact point. Accordingly, the occurrence of corrosion can be suppressed. In addition, even in a case where some corrosion occurs, in a case where this corrosion occurs at a small contact point, the corroded point can be scraped off by the protrusion and the second member rubbing together before the corroded point grows. Accordingly, spreading of the corroded point can be suppressed, and the increase in the resistance value between the contact and the second member can be suppressed.

Further, the protrusion described above is provided at a location separated from a boundary between the contact portion and the spring portion by greater than or equal to 0.9 mm toward the contact portion. The boundary between the contact portion and the spring portion is the boundary between the flat plate portion and the bent portion. The protrusion provided at such a location can prevent the flat plate portion from swinging up and down like a seesaw with the protrusion as a fulcrum, in comparison to cases where similar protrusions are provided at locations separated from the boundary between the contact portion and the spring portion by less than 0.9 mm toward the contact portion. This can prevent the stress that acts in the vicinity of the boundary between the contact portion and the spring portion from becoming excessive and the spring portion from breaking. Accordingly, even when the contact is used in an environment in which vibration is transmitted, such as in a vehicle-mounted device, for example, breakage of the spring portion can be suppressed over a long period of time, and the contact can function effectively.

REFERENCE SIGNS LIST

Figure 1A:
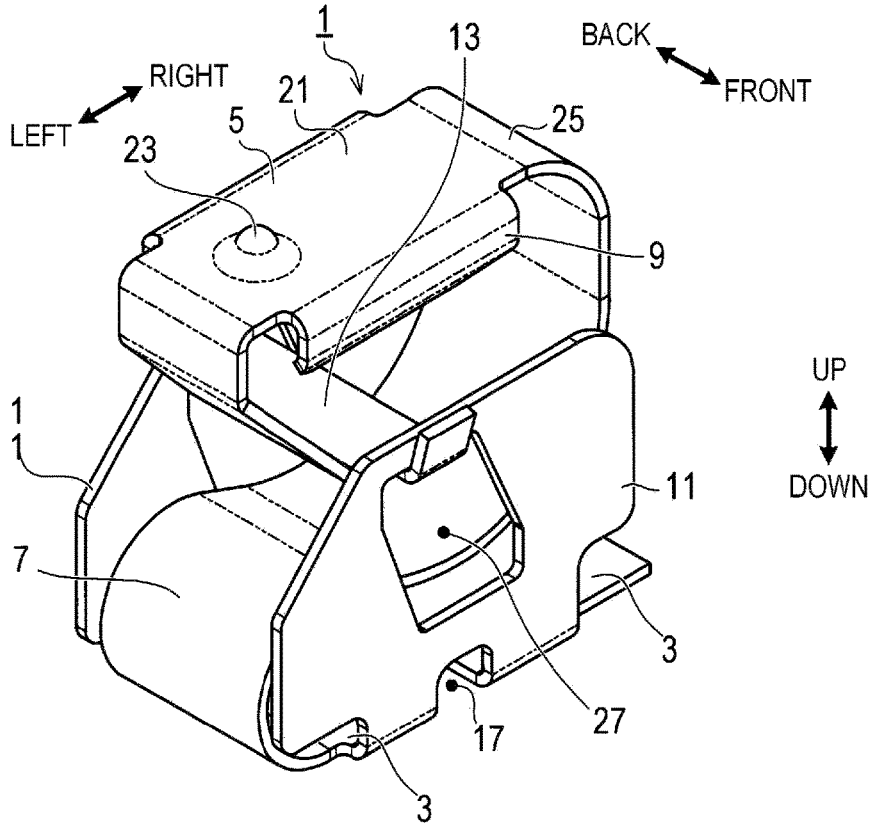
FIG. 1A is a perspective view of a contact as viewed from a left front upper side.
Figure 1B:
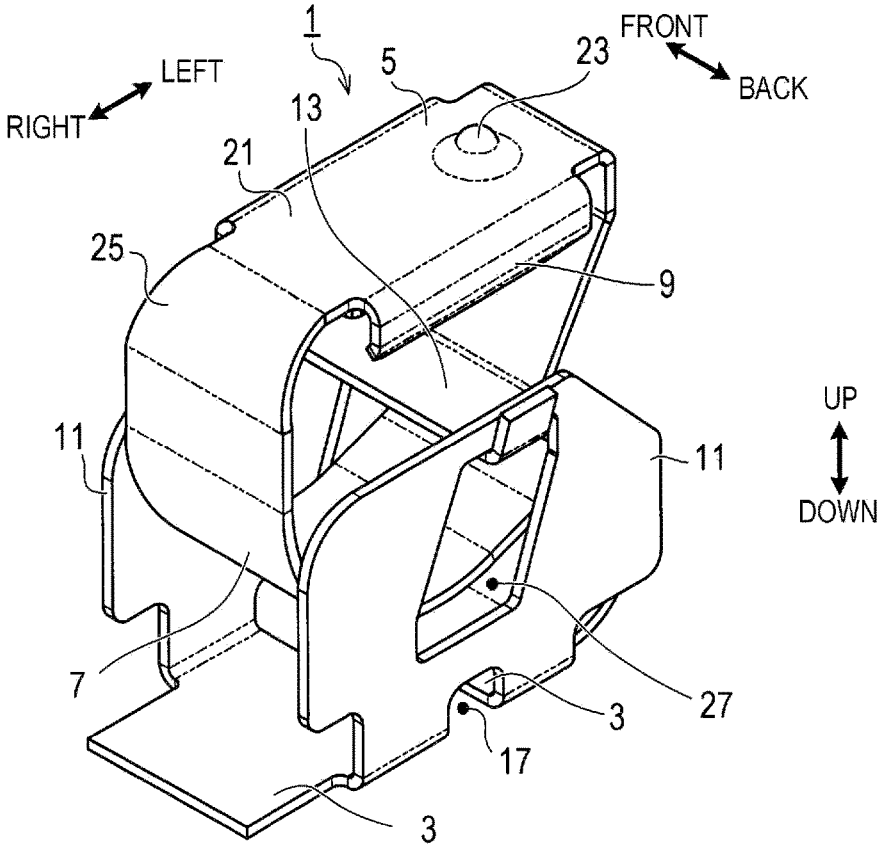
FIG. 1B is a perspective view of the contact as viewed from a right rear upper side.
Figure 2A:
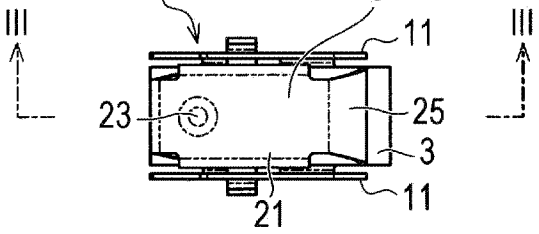
FIG. 2A is a plan view of a contact.
Figure 2C:
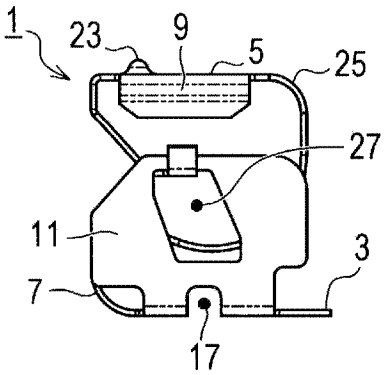
FIG. 2C is a front view of a contact.
Figure 2D:
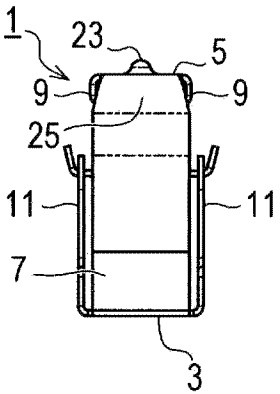
FIG. 2D is a right side view of a contact.
Figure 2E:
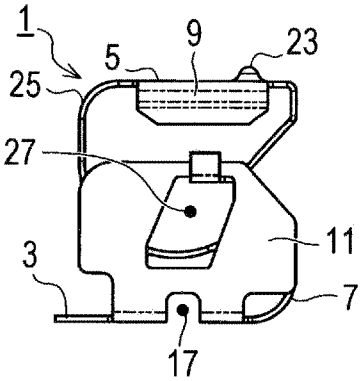
FIG. 2E is a rear view of a contact.
Figure 2B:
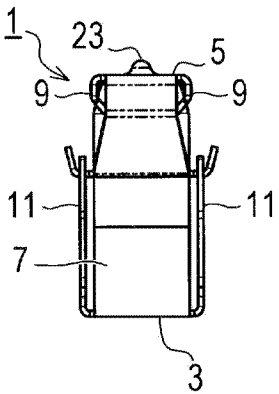
FIG. 2B is a left side view of a contact.
Figure 2F:
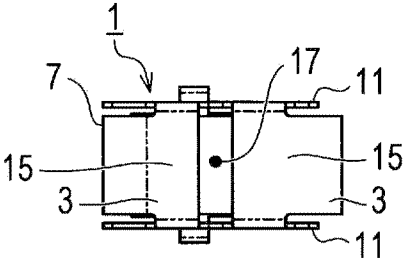
FIG. 2F is a bottom view of a contact.
Figure 3:
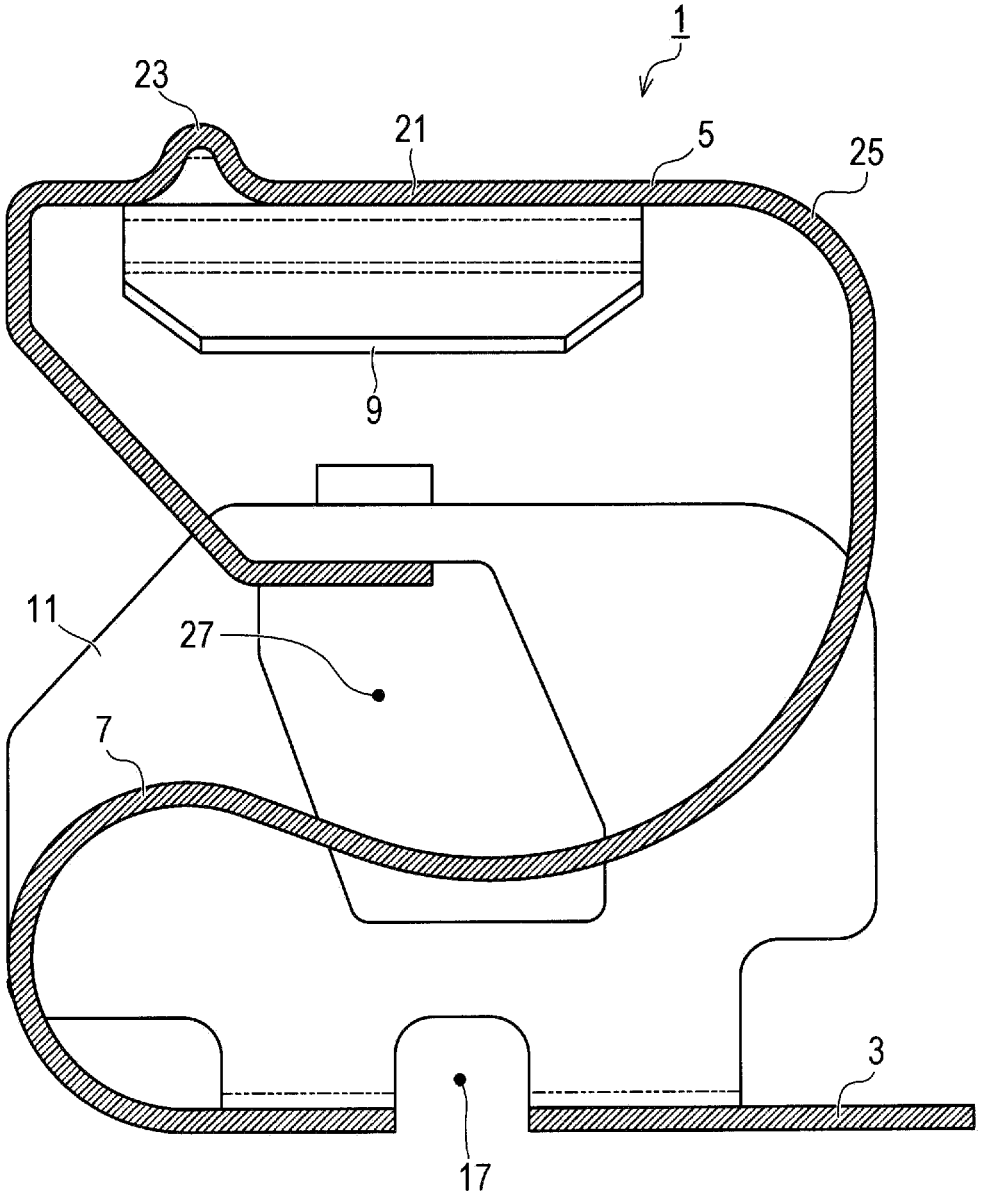
FIG. 3 is a cross-sectional view taken along a line in FIG. 2A.

1 Contact
3 Base portion
5 Contact portion
7 Spring portion
9 Extending portion
11 Standing wall
13 Engaging portion
15 Joining surface
17 Opening
21 Flat plate portion
23 Protrusion
25 Bent portion
27 Engaging hole

DESCRIPTION OF EMBODIMENTS

The contact described above will be described next according to exemplary embodiments. In the following description, descriptions will be made using the front, back, left, right, up, and down directions illustrated in the drawings. In the diagrams of the six sides of the contact (see FIG. 2A to FIG. 2F), each of these directions is defined relatively, such that the direction in which the part represented in the front view is oriented is defined as the front, the direction in which the part represented in the rear view is oriented is defined as the back, the direction in which the part represented in the left side view is oriented is defined as the left, the direction in which the part represented in the right side view is oriented is defined as the right, the direction in which the part represented in the plan view is oriented is defined as the up, and the direction in which the part represented in the bottom view is oriented is defined as the down. However, these directions are defined only for the purpose of facilitating a simple description of the relative positional relationships of each part constituting the contact. Accordingly, at the time of use of the contact, for example, the directions in which the contact is disposed are freely selected.

Contact Configuration

As illustrated in FIG. 1A, FIG. 1B, FIG. 2A, FIG. 2B, FIG. 2C, FIG. 2D, FIG. 2E, FIG. 2F, and FIG. 3, a contact 1 is a component configured to be capable of electrically connecting a first member and a second member by being attached to the first member and sandwiched between the first member and the second member. An electronic circuit board can be mentioned as an example of the first member, for instance. In this case, the contact 1 is soldered to the conductor pattern of the electronic circuit board. A conductive member other than the electronic circuit board can be mentioned as an example of the second member, and examples thereof can include a metallic case, a metallic panel, a metallic frame, or a variety of components covered with a metal plating provided for electronic equipment.

The contact 1 includes a base portion 3, a contact portion 5, a spring portion 7, two extending portions 9, 9, two standing walls 11, 11, and an engaging portion 13. The base portion 3, the contact portion 5, the spring portion 7, the two extending portions 9, 9, the two standing walls 11, 11, and the engaging portion 13 are integrally formed with a thin plate made of metal (in the case of the present embodiment, a thin plate made of beryllium copper for springs with a tin plating that has undergone reflow treatment). In the case of the present embodiment, the thickness of the thin plate ranges from 0.1 mm to 0.15 mm (a case where the thickness is 0.12 mm is exemplified in the drawings). In addition, the contact 1 is configured to have a shape with outer dimensions (the horizontal direction dimension×the front-back direction dimension×the vertical direction dimension in the drawings) within a range from 2 mm×2 mm×2 mm to 10 mm×10 mm×10 mm (a case where the outer dimensions are 5 mm×3.2 mm×5.3 mm is exemplified in the drawings).

The base portion 3 is configured to be fixable to the first member. In the case of the present embodiment, an electronic circuit board is assumed as the first member. For this reason, the base portion 3 is provided with a joining surface 15 to be soldered to the conductor pattern of the electronic circuit board, and is configured to be fixable to the electronic circuit board by soldering. In addition, in the case of the present embodiment, an opening 17 is provided in a range extending from the base portion 3 to the two standing walls 11, 11. For this reason, the base portion 3 is divided into two sides that sandwich the opening 17 (both sides in the horizontal direction in the drawings).

The contact portion 5 is configured to make contact with the second member at at least one contact point. The contact portion 5 includes a flat plate portion 21 and a protrusion 23. The upper surface side of the flat plate portion 21 in the drawings is a suction surface that can be sucked by a suction nozzle of an automatic mounting machine. This allows the contact 1 to arranged on the electronic circuit board by the automatic mounting machine and to be surface-mounted on the electronic circuit board.

The protrusion 23 protrudes toward the second member and is configured to make contact with the second member. That is, in the case of the present embodiment, one of the at least one contact point is constituted by the protrusion 23 described above. In the case of the present embodiment, the height of the protrusion 23 (the protrusion amount from the flat plate portion 21) ranges from 0.15 mm to 0.35 mm (a case where the height of the protrusion 23 is 0.3 mm is exemplified in the drawings).

In addition, a direction (the front-back direction in the drawings), orthogonal to both the direction (the horizontal direction in the drawings) in which the flat plate portion 21 extends from a bent portion 25 and the thickness direction (the vertical direction in the drawings) of the thin plate in the flat plate portion 21, is set as a width direction of the flat plate portion 21, and the protrusion 23 is provided at the center in the width direction of the flat plate portion 21. In this way, the protrusion 23 is formed at a location away from the end face of the thin plate (the end faces at both ends in the front-back direction of the flat plate portion 21). Further, there are no points that penetrate the thin plate on the surface of the protrusion 23. Accordingly, the surface of the protrusion 23 is structured to be covered over its entire surface with the plating film (tin-plated film) of the thin plate, and has a structure in which the base metal (beryllium copper for springs) of the thin plate is not exposed.

The spring portion 7 is configured to be elastically deformable between both ends. One end of the spring portion 7 is a fixed end connected to the base portion 3, and the other end of the spring portion 7 is a free end connected to the contact portion 5. In this way, the spring portion 7 displaceably supports the contact portion 5. In the spring portion 7, the bent portion 25, curved in a direction in which the thickness direction of the thin plate is a radial direction, is provided in a portion connected to the contact portion 5. The above-mentioned flat plate portion 21 extends in a flat plate shape from one end of the bent portion 25. That is, the boundary between the flat plate portion 21 and the bent portion 25 is the boundary between the contact portion 5 and the spring portion 7.

The two extending portions 9, 9 are provided at both ends of the flat plate portion 21 in the width direction (the front-back direction in the drawings), are curved from both ends and extend in a direction opposite to a protruding direction of the protrusion 23. The two standing walls 11, 11 extend from the base portion 3 and are disposed at positions on both sides (both sides in the front-back direction in the drawings) of the spring portion 7. The engaging portion 13 extends from an end portion of the flat plate portion 21 on an opposite side from the bent portion 25. An engaging hole 27 is provided in each of the two standing walls 11, 11, and the movement range of the contact portion 5 is configured to be restricted by the engaging portion 13 catching in the engaging hole 27.

Cold-Heat Shock Test

A cold-heat shock test was carried out using the contact 1 (example) and a contact configured similarly to the above-described contact 1 (comparative example) with the exception that the protrusion 23 was absent. As a specific test procedure, each of the contacts described above and measurement terminals were soldered to the substrate. Subsequently, a gold-plated copper plate was used as the second member to be made contact with the contact portion 5, and the gold-plated copper plate and the contact portion 5 were brought into contact with each other and fixed between the sheet metals to prepare a specimen.

Next, after measuring the initial direct current resistance value between the measurement terminals and the gold-plated copper plate, the specimen was placed in a commercially available cold-heat shock device, and processing was carried out such that the ambient temperature in the device repeatedly alternated between states of −40° C. and 150° C. After processing of a predetermined number of cycles, the specimen was removed from the cold-heat shock device, and the direct current resistance value (average value, maximum value, and minimum value) between the measurement terminals and the gold-plated copper plate was measured after the treatment. The test results are shown in the following Table 1.

TABLE 1

Unit: mΩ

| | | Number of cycles | | | | |
|---|---|---|---|---|---|---|
| | | 0 | 250 | 500 | 750 | 1000 |
| With protrusion | Resistance (Average value) | 8 | 10 | 11 | 11 | 12 |
| | Resistance (Maximum value) | 9 | 12 | 16 | 16 | 16 |
| | Resistance (Minimum value) | 8 | 8 | 9 | 9 | 9 |

TABLE 1-continued

Unit: mΩ

| | | Number of cycles | | | | |
|---|---|---|---|---|---|---|
| | | 0 | 250 | 500 | 750 | 1000 |
| Without protrusion | Resistance (Average value) | 7 | 120 | 57 | 67 | 330 |
| | Resistance (Maximum value) | 8 | 1005 | 191 | 279 | 1403 |
| | Resistance (Minimum value) | 6 | 8 | 11 | 21 | 25 |

As a result of the above test, in a case that the protrusion 23 was present, the maximum value of the direct current resistance value, which was 9 mΩ at the initial time (at the time of 0 cycles), slightly increased to 12 mΩ at the time of 250 cycles. Subsequently, however, it stabilized at 16 mΩ at 500 cycles, 16 mΩ at 750 cycles, and 16 mΩ at 1000 cycles, and no further significant increase in resistance value was observed.

In contrast, in a case that the protrusion 23 was absent, the maximum value of the direct current resistance value, which was 8 mΩ at the initial time (at the time of 0 cycles), abruptly increased to 1005 mΩ at the time of 250 cycles. Subsequently, the resistance value decreased to 191 mΩ at 500 cycles, the resistance value increased to 279 mΩ at 750 cycles, and the resistance value abruptly increased to 1403 mΩ at 1000 cycles. From this, it was discovered that, in the case that the protrusion 23 is absent, the resistance value between the contact portion 5 and the second member unstably fluctuates.

Incidentally, even in a case where the contact and the second member are brought into contact with each other after a similar heat treatment is performed with respect to each individual component in a state where the contact is not in contact with the second member (a gold-plated copper plate in the present embodiment), and the direct current resistance value is measured, the direct current resistance value barely changes (+approximately several mΩ to several tens of mΩ). In contrast, in a case that a cold-heat shock test is performed with respect to a specimen in which the contact is in contact with the second member as in the above-mentioned test, the direct current resistance value increases as in the above test result. Accordingly, it is presumed that the reason that the resistance value abruptly rises in cases where the protrusion 23 is absent, as in the above-described test, is due to the fact that dissimilar metal contact corrosion occurs at the boundary between the contact portion 5 and the second member, and a substance having a high electric resistance value is generated.

In addition, it is presumed that the reason why the increased resistance temporarily decreases is that the contact portion 5 and the second member rub against each other due to the repeated expansion and contraction caused by the temperature change during the cold-heat shock test, and as a result, the substances with high electrical resistance generated at the boundary between both of them are scraped off.

In contrast, it is presumed that the reason why the resistance value barely increases in cases that the protrusion 23 is present is that, since the tip of the protrusion 23 is in contact with the second member, the range in which dissimilar metal contact corrosion can occur is narrow, and further, the contact pressure increases, even in a case where corrosion occurs, the substance with the high electrical resistance is easily scraped off in a case that the protrusion 23 and the second member rub against each other, and thus the electric resistance value hardly increases.

Note that the same trend was also observed in a case where the material of the second member was changed to an aluminum alloy, and although the resistance value barely increased in the case that the protrusion 23 was present, there was a tendency for the resistance value to rise abruptly in the case that an equivalent to the protrusion 23 was absent.

Protrusion Location

Next, the location of the protrusion 23 was verified. Specifically, the location of the protrusion 23 was changed seven times, the contact was horizontally compressed from above for each of these seven cases, and the magnitude of the stress generated in the bent portion 25 and the swing angle of the contact portion 5 were verified with simulation software capable of executing fatigue analysis. Note that, in the case of the present embodiment, SOLIDWORKS Simulation Premium (available from Dassault Systemes SolidWorks) was used as the simulation software.

With regard to the locations of the protrusion 23, the distance X (hereinafter also referred to as protrusion location X) from the boundary between the contact portion 5 and the spring portion 7 to the protrusion 23 was modified as shown in Table 2 below. With regard to the height of the protrusion 23, three types of heights of 0.15 mm, 0.25 mm, and 0.35 mm were verified. In addition, in the following Table 2, the "spring tip swing angle (upper side)" is the maximum angle when the contact portion 5 inclines in the direction of the upward gradient from the spring portion 7 side to the engaging portion 13 side as a result of the vibration of the contact portion 5, and the "spring tip swing angle (lower side)" is the maximum angle when the contact portion 5 inclines in the direction of the downward gradient from the spring portion 7 side to the engaging portion 13 side as a result of the vibration of the contact portion 5. In a case that these angles are large, the swinging of the contact portion 5 is large, and in a case that these angles are 0°, this means that the contact portion 5 cannot swing from the horizontal state. The above results are shown in Table 2.

TABLE 2

| | | Protrusion Location X [mm] | | | | | | |
|---|---|---|---|---|---|---|---|---|
| | | 0.5 | 0.7 | 0.9 | 1.1 | 1.3 | 1.5 | 2.7 |
| Protrusion Height 0.15 mm | Spring tip swing angle (Upper side) [Degrees] | 2 | 2 | 0 | 0 | 0 | 0 | 0 |
| | Spring tip swing angle (Lower side) [Degrees] | 8 | 6 | 5 | 5 | 4 | 4 | 2 |
| | Stress [MPa] | 453 | 366.9 | 213.4 | 213.4 | 170.5 | 170.5 | 110.6 |
| Protrusion Height 0.25 mm | Spring tip swing angle (Upper side) [Degrees] | 5 | 4 | 0 | 0 | 0 | 0 | 0 |
| | Spring tip swing angle (Lower side) [Degrees] | 19 | 14 | 14 | 12 | 10 | 10 | 7 |
| | Stress [MPa] | 946.3 | 728.7 | 558.2 | 497.8 | 428.7 | 428.7 | 299.3 |
| Protrusion Height 0.35 mm | Spring tip swing angle (Upper side) [Degrees] | 4 | 2 | 0 | 0 | 0 | 0 | 0 |
| | Spring tip swing angle (Lower side) [Degrees] | 10 | 10 | 10 | 10 | 10 | 10 | 7 |
| | Stress [MPa] | 599.2 | 539.3 | 428.7 | 428.7 | 428.7 | 428.7 | 428.7 |

From the above verification results, it can be understood that regardless of whether the height of the protrusion 23 is 0.15 mm, 0.25 mm, or 0.35 mm, when the protrusion location X becomes less than or equal to 0.7 mm, the "spring tip swing angle (upper side)" becomes greater than 0. In addition, it can be understood that when the protrusion location X becomes greater than or equal to 0.9 mm, the "spring tip swing angle (lower side)" becomes 0. That is, when the protrusion location X becomes greater than or equal to 0.9 mm, the contact portion 5 does not swing in a direction inclined in the direction of the upward gradient from the spring portion 7 side to the engaging portion 13 side.

Figure 4A:
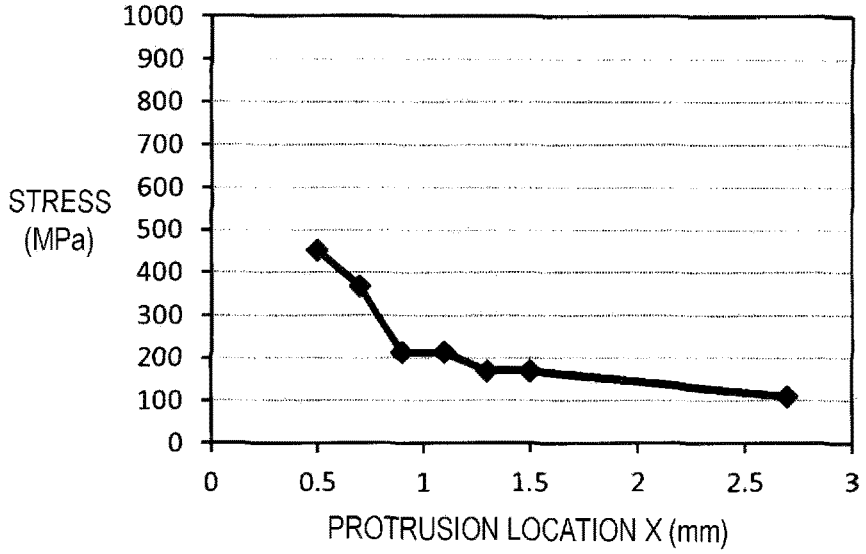
FIG. 4A is a graph illustrating a relationship between a protrusion location and the generated stress in a case that the height of a protrusion is 0.15 mm.
Figure 4B:
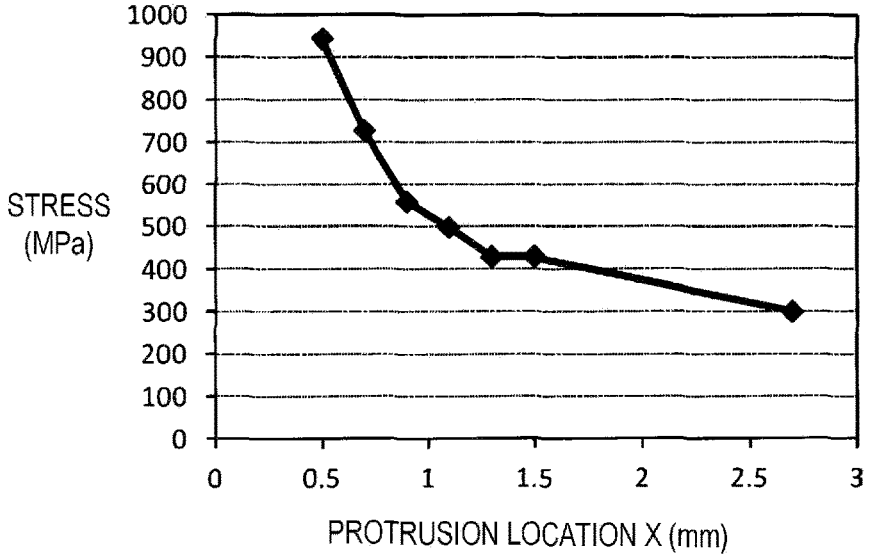
FIG. 4B is a graph illustrating the relationship between the protrusion location and the generated stress in a case that the height of the protrusion is 0.25 mm.
Figure 4C:
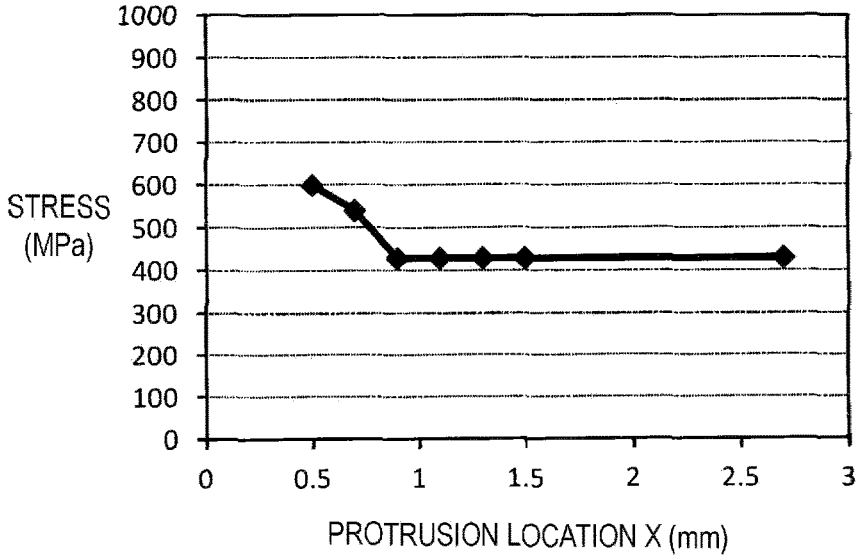
FIG. 4C is a graph illustrating the relationship between the protrusion location and the generated stress in a case that the height of the protrusion is 0.35 mm.

FIG. 4A, FIG. 4B, and FIG. 4C are graphs showing a relationship between a protrusion location X and the generated stress. As is clear from these graphs, it can be understood that although the generated stress does not fluctuate to an extremely large extent when the protrusion location X is within the range from 0.9 mm to 2.7 mm, the generated stress abruptly increases when the protrusion location X is less than or equal to 0.7 mm.

That is, with a protrusion location X of less than or equal to 0.7 mm, when the vibration is transmitted to the contact portion 5, the contact portion 5 swings up and down with respect to the horizontal location, and the generated stress also becomes relatively large. In contrast, with a protrusion location X of greater than or equal to 0.9 mm, when the vibration is transmitted to the contact portion 5, the contact portion 5 only swings downward from the horizontal position, and the generated stress also becomes relatively small. That is, the stress generation trend varies with the protrusion location X=0.9 mm as a boundary.

Accordingly, to reduce the risk of damage to the spring portion 7, it is effective to set the protrusion location X to greater than or equal to 0.9 mm. Note that, even when the protrusion location X was changed to the above-described seven locations, there was no change in the Z characteristics, and regardless of which location the protrusion location X was set to, a certain effect was observed with respect to the EMC countermeasure effect.

Effects

As described above, according to the contact 1 described above, the contact portion 5 comes into contact with the second member at the tip of the protrusion 23 as described above. For this reason, as compared with cases in which such a protrusion 23 is not provided, the contact 1 can be brought into contact with the second member at a small contact point. Accordingly, the contact pressure can be increased in comparison to contacts 1 without protrusions 23 that come into contact with the second member with a large contact surface, and since this can prevent oxygen, water, or the like from entering the contact point, the occurrence of corrosion can be suppressed. In addition, even in a case where some corrosion occurs, if this corrosion occurs at a small contact point, the corroded point can be scraped off by the protrusion 23 and the second member rubbing together before the corroded point grows. Accordingly, as a result of these effects, spreading of the corroded point can be suppressed, and the increase in the resistance value between the contact 1 and the second member can be suppressed.

Further, the protrusion 23 described above is provided at a location separated from the boundary between the contact portion 5 and the spring portion 7 by greater than or equal to 0.9 mm toward the contact portion 5. For this reason, in comparison to cases where similar protrusions 23 are provided at locations that are separated from the boundary between the contact portion 5 and the spring portion 7 by less than 0.9 mm toward the contact portion 5, it is possible to prevent the flat plate portion 21 from swinging up and down like a seesaw with the protrusion 23 as a fulcrum. This can prevent the stress that acts in the vicinity of the boundary between the contact portion 5 and the spring portion 7 from becoming excessive and the spring portion 7 from breaking. Accordingly, even when the contact 1 is used in an environment in which vibration is transmitted, such as in a vehicle-mounted device, for example, breakage of the spring portion 7 can be suppressed over a long period of time, and the contact 1 can function effectively.

In addition, in the case of the contact 1 described above, since the outer dimensions are greater than or equal to 2 mm×2 mm×2 mm, it can be easily fixed to the first member in comparison with contacts 1 having outer dimensions that are excessively small. In addition, since the outer dimensions are less than or equal to 10 mm×10 mm×10 mm, the contact 1 can be easily arranged even in narrow regions, unlike contacts 1 having outer dimensions that are excessively large.

In addition, in the case of the contact 1 described above, since the height of the protrusion 23 is greater than or equal to 0.15 mm, the protrusion 23 can be made to effectively function to suppress the occurrence of corrosion, and an increase in the resistance value between the contact 1 and the second member can be suppressed. In addition, since the height of the protrusion 23 is less than or equal to 0.35 mm, the likelihood that an excessive load is applied to the spring portion 7 can be reduced.

In addition, in the case of the contact 1 described above, since the thickness of the thin plate is greater than or equal to 0.10 mm, the elasticity of the spring portion 7 can be properly ensured in comparison with cases where the plate thickness is less than 0.1 mm. Also, it is possible to secure an appropriate rigidity at portions other than the spring portion 7. In addition, since the thickness of the thin plate is less than or equal to 0.15 mm, it is possible to prevent the rigidity of the spring portion 7 from becoming excessively high in comparison with cases where the plate thickness exceeds 0.15 mm.

In addition, in the case of the contact 1 described above, the two extending portions 9, 9 as described above can prevent foreign matter from entering a location opposite to the second member across the flat plate portion 21. Accordingly, it is possible to suppress such foreign matter from getting caught by the contact portion 5, and to prevent the contact portion 5 from being pulled up by the caught foreign matter. In addition, in a case that two extending portions 9, 9 are provided at both ends in the width direction of the flat plate portion 21, the bending rigidity of the flat plate portion 21 can be improved in comparison with cases where the two extending portions 9, 9 are not provided. When the protrusion 23 is provided on such a flat plate portion 21 having high bending rigidity, it is possible to press the protrusion 23 more strongly against the second member, and to improve the effect of suppressing the occurrence of corrosion.

In addition, in the case of the contact 1 described above, even in a case where an external force that pulls up the contact portion 5 acts on the contact portion 5, in such a case, the movement range of the contact portion 5 is restricted by the engaging portion 13 catching in the engaging holes 27 provided in each of the two standing walls 11, 11. Accordingly, it is possible to suppress the contact portion 5 from being excessively pulled up. In addition, by the engaging portion 13 engaging with the engaging hole 27 of each of the two standing walls 11, 11, displacement of the base portion 3 and the contact portion 5 in a direction in which they twist relative to each other is also suppressed. As a result, the occurrence of twisting in the spring portion 7 can be suppressed, and the risk of damage to the spring portion 7 can be reduced.

In addition, in the case of the contact 1 described above, since the surface of the protrusion 23 is covered with a plating film, the plating film can be constituted by a metal type that allows a potential difference between the plating film and the second member to be less than that between the base metal of the contact 1 and the second member. In this case, the corrosion that occurs between the protrusion 23 and the second member can be suppressed in comparison with cases in which the plating film is not provided.

Other Embodiments

Although the contact has been described with reference to exemplary embodiments, the above-described embodiments should not be construed to be any more than an example of one aspect of the present disclosure. In other words, the present disclosure is not limited to the exemplary embodiment described above and can be embodied in various forms without departing from the technical concept of the present disclosure.

For example, although the shape of the protrusion 23 is specifically exemplified in the above-described embodiments, it suffices for the protrusion 23 to come into contact with the second member and to be electrically connected to the second member, and the shape thereof is not limited to a specific shape. However, in a case that at least the tip portion of the protrusion 23 has a hemispherical shape corresponding to half of a sphere, or a shape corresponding to a half of a spheroid, even in cases where the contact angle between the flat plate portion 21 and the second member changes, point contact is maintained and the contact pressure is not dispersed, which is preferable.

In addition, in the above embodiment, although two standing walls 11, 11 extend from the base portion 3 and an engaging portion 13 extends from the contact portion 5, two standing walls may extend from the contact portion 5 such that the engaging portion 13 is configured to extend from the base portion 3. Even in this case, it is possible to restrict the movement range of the contact portion by providing the engaging hole in each of the two standing walls such that the engaging portion is configured to be caught in the engaging holes.

In addition, in the above-described embodiments, although it is described that the contact 1 is configured to have a shape with outer dimensions within a range from 2 mm×2 mm×2 mm to 10 mm×10 mm×10 mm, whether the outer dimensions are configured to fall within the above range is freely selected. Similarly, in the above-described embodiments, although it is described that the height of the protrusion is configured to range from 0.15 mm to 0.35 mm, whether the height of the protrusion is configured as described above is freely selected. In addition, in the above-described embodiments, although it is described that the thickness of the thin plate ranges from 0.1 mm to 0.15 mm, whether the plate thickness of the thin plate is configured to fall within the above range is freely selected.

In addition, in the above-described embodiments, although an example is described in which the contact 1 includes the two extending portions 9, 9, whether the two extending portions 9, 9 are provided is freely selected. Similarly, in the above-described embodiments, although an example is illustrated in which the contact 1 includes the two standing walls 11, 11 and the engaging portion 13, whether the two standing walls 11, 11 and the engaging portion 13 are provided is freely selected. In addition, in the above-described embodiment, although an example is illustrated in which the surface of the protrusion 23 is configured to be covered with the plating film, whether the surface of the protrusion 23 is covered with the plating film is freely selected.

Additionally, a predetermined function realized by a single constituent element in the above-described embodiments may instead be realized by a plurality of constituent elements working in tandem. Alternatively, a plurality of functions provided by a corresponding plurality of constituent elements, or a predetermined function realized by a plurality of constituent elements working in tandem, may be realized by a single constituent element. Parts of the configurations in the above-described embodiments may be omitted. At least a part of the configuration of one of the above-described embodiments may be added to or replace the configuration of another of the above-described embodiments. Note that all aspects encompassed within the technical spirit defined by the language of the appended claims fall within the scope of the present disclosure.

Supplementary Description

Note that as is clear from the exemplary embodiment described above, the contact according to the present disclosure may be further provided with configurations such as those given below.

First, the contact of the present disclosure may be configured to have a shape with outer dimensions within a range from 2 mm×2 mm×2 mm to 10 mm×10 mm×10 mm. According to a contact configured in this manner, since the outer dimensions are greater than or equal to 2 mm×2 mm×2 mm, the contact can be easily fixed to the first member in comparison with contacts having outer dimensions that are excessively small. In addition, since the outer dimensions are less than or equal to 10 mm×10 mm×10 mm, the contact can be easily arranged even in narrow regions, unlike contacts having outer dimensions that are excessively large.

In addition, in the contact of the present disclosure, the height of the protrusion may range from 0.15 mm to 0.35 mm. According to a contact configured in this manner, since the height of the protrusion is greater than or equal to 0.15 mm, the protrusion can be made to effectively function to suppress the occurrence of corrosion, and an increase in the resistance value between the contact and the second member can be suppressed. In addition, since the height of the protrusion is less than or equal to 0.35 mm, the likelihood that an excessive load is applied to the spring portion can be reduced.

In addition, in the contact of the present disclosure, a direction, orthogonal to both the direction in which the flat plate portion extends from the bent portion and the thickness direction of the thin plate in the flat plate portion, may be set as a width direction of the flat plate portion; and at both ends in the width direction of the flat plate portion, extending portions that are curved from the both ends and extend in a direction opposite to a protruding direction of the protrusion may be provided. According to a contact configured in this manner, the extending portions as described above can prevent foreign matter from entering a location opposite to the second member across the flat plate portion.

Accordingly, it is possible to suppress such foreign matter from getting caught by the contact portion, and to prevent the contact portion from being pulled up by the caught foreign matter. In addition, since the extending portions are provided at both ends in the width direction of the flat plate portion, the bending rigidity of the flat plate portion can be improved in comparison with cases where similar extending portions are not provided. Accordingly, when the protrusion is provided on such a flat plate portion having high bending rigidity, it is possible to press the protrusion more strongly against the second member, and to improve the effect of suppressing the occurrence of corrosion.

In addition, in the contact of the present disclosure, the contact includes a standing wall extending from the base portion and an engaging portion extending from an end portion of the flat plate portion on an opposite side from the bent portion, and an engaging hole is provided in the standing wall such that the movement range of the contact portion may be restricted by the engaging portion catching in the engaging hole. According to a contact configured in this manner, even in a case where an external force that pulls up the contact portion acts on the contact portion, for example, in such a case, the movement range of the contact portion is restricted by the engaging portion catching in the engaging holes provided in the standing walls.

Accordingly, it is possible to suppress the contact portion from being excessively pulled up. In addition, by the engaging portion engaging with the engaging holes of the standing walls, the displacement of the base portion and the contact portion in a direction in which they twist relative to each other is also suppressed. As a result, the occurrence of twisting in the spring portion can be suppressed, and the risk of damage to the spring portion can be reduced.

The invention claimed is:

1. A contact configured to be capable of electrically connecting a first member and a second member by being attached to the first member and sandwiched between the first member and the second member, the contact comprising:

a base portion fixable to the first member;

a contact portion configured to make contact with the second member at at least one contact point; and a spring portion configured to be elastically deformable between both ends, where one end is a fixed end connected to the base portion and another end is a free end connected to the contact portion, and to displaceably support the contact portion, wherein the base portion, the contact portion, and the spring portion are integrally formed with a thin plate made of metal, the spring portion includes a bent portion curved in a direction in which a thickness direction of the thin plate is a radial direction, the contact portion includes a flat plate portion extending in a flat plate shape from one end of the bent portion, a protrusion protruding toward the second member is provided on the flat plate portion as one of the at least one contact point, and the protrusion is provided at a location separated from a boundary between the contact portion and the spring portion by greater than or equal to 0.9 mm toward the contact portion, is configured to have a height ranging from 0.15 mm to 0.35 mm, and is configured to prevent the spring portion from breaking, the contact further comprising:

a standing wall extending from the base portion; and an engaging portion extending from an end portion of the flat plate portion on an opposite side from the bent portion, wherein the contact is configured such that an engaging hole is provided in the standing wall, and a movement range of the contact portion is restricted by the engaging portion catching in the engaging hole.

2. The contact according to claim 1, wherein the contact is configured to have a shape with outer dimensions within a range from 2 mm×2 mm×2 mm to 10 mm×10 mm×10 mm.

3. A contact configured to be capable of electrically connecting a first member and a second member by being attached to the first member and sandwiched between the first member and the second member, the contact comprising:

a base portion fixable to the first member;

a contact portion configured to make contact with the second member at at least one contact point; and a spring portion configured to be elastically deformable between both ends, where one end is a fixed end connected to the base portion and another end is a free end connected to the contact portion, and to displaceably support the contact portion, wherein the base portion, the contact portion, and the spring portion are integrally formed with a thin plate made of metal, the spring portion includes a bent portion curved in a direction in which a thickness direction of the thin plate is a radial direction, the contact portion includes a flat plate portion extending in a flat plate shape from one end of the bent portion, a protrusion protruding toward the second member is provided on the flat plate portion as one of the at least one contact point, the protrusion is provided at a location separated from a boundary between the contact portion and the spring portion by greater than or equal to 0.9 mm toward the contact portion, is configured to have a height ranging from 0.15 mm to 0.35 mm, and is configured to prevent the spring portion from breaking, the contact is configured to have a shape with outer dimensions within a range from 2 mm×2 mm×2 mm to 10 mm×10 mm×10 mm, a direction, orthogonal to both a direction in which the flat plate portion extends from the bent portion and the thickness direction of the thin plate in the flat plate portion, is set as a width direction of the flat plate portion, and at both ends in the width direction of the flat plate portion, extending portions, curved from the both ends and extending in a direction opposite to a protruding direction of the protrusion, are provided.

4. A contact configured to be capable of electrically connecting a first member and a second member by being attached to the first member and sandwiched between the first member and the second member, the contact comprising:

a base portion fixable to the first member;

a contact portion configured to make contact with the second member at at least one contact point; and a spring portion configured to be elastically deformable between both ends, where one end is a fixed end connected to the base portion and another end is a free end connected to the contact portion, and to displaceably support the contact portion, wherein the base portion, the contact portion, and the spring portion are integrally formed with a thin plate made of metal, the spring portion includes a bent portion curved in a direction in which a thickness direction of the thin plate is a radial direction, the contact portion includes a flat plate portion extending in a flat plate shape from one end of the bent portion, a protrusion protruding toward the second member is provided on the flat plate portion as one of the at least one contact point, the protrusion is provided at a location separated from a boundary between the contact portion and the spring portion by greater than or equal to 0.9 mm toward the contact portion, is configured to have a height ranging from 0.15 mm to 0.35 mm, and is configured to prevent the spring portion from breaking, and the contact is configured to have a shape with outer dimensions within a range from 2 mm×2 mm×2 mm to 10 mm×10 mm×10 mm, the contact further comprising:

a standing wall extending from the base portion; and an engaging portion extending from an end portion of the flat plate portion on an opposite side from the bent portion, wherein the contact is configured such that an engaging hole is provided in the standing wall, and a movement range of the contact portion is restricted by the engaging portion catching in the engaging hole.

5. A contact configured to be capable of electrically connecting a first member and a second member by being attached to the first member and sandwiched between the first member and the second member, the contact comprising:

a base portion fixable to the first member;

a contact portion configured to make contact with the second member at at least one contact point; and a spring portion configured to be elastically deformable between both ends, where one end is a fixed end connected to the base portion and another end is a free end connected to the contact portion, and to displaceably support the contact portion, wherein the base portion, the contact portion, and the spring portion are integrally formed with a thin plate made of metal, the spring portion includes a bent portion curved in a direction in which a thickness direction of the thin plate is a radial direction, the contact portion includes a flat plate portion extending in a flat plate shape from one end of the bent portion, a protrusion protruding toward the second member is provided on the flat plate portion as one of the at least one contact point, the protrusion is provided at a location separated from a boundary between the contact portion and the spring portion by greater than or equal to 0.9 mm toward the contact portion, is configured to have a height ranging from 0.15 mm to 0.35 mm, and is configured to prevent the spring portion from breaking, a direction, orthogonal to both a direction in which the flat plate portion extends from the bent portion and the thickness direction of the thin plate in the flat plate portion, is set as a width direction of the flat plate portion, and at both ends in the width direction of the flat plate portion, extending portions, curved from the both ends and extending in a direction opposite to a protruding direction of the protrusion, are provided, the contact further comprising:

a standing wall extending from the base portion; and an engaging portion extending from an end portion of the flat plate portion on an opposite side from the bent portion, wherein the contact is configured such that an engaging hole is provided in the standing wall, and a movement range of the contact portion is restricted by the engaging portion catching in the engaging hole.

6. The contact according to claim 3, further comprising:

a standing wall extending from the base portion; and an engaging portion extending from an end portion of the flat plate portion on an opposite side from the bent portion, wherein the contact is configured such that an engaging hole is provided in the standing wall, and a movement range of the contact portion is restricted by the engaging portion catching in the engaging hole.

* * * * *